US007155153B2

(12) United States Patent
Taguchi

(10) Patent No.: US 7,155,153 B2
(45) Date of Patent: Dec. 26, 2006

(54) IMAGE TRANSFER MECHANISM AND IMAGE FORMING DEVICE USING THE MECHANISM

(75) Inventor: Yoshiyuki Taguchi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 174 days.

(21) Appl. No.: 10/502,888

(22) PCT Filed: Mar. 18, 2002

(86) PCT No.: PCT/JP02/02535

§ 371 (c)(1),
(2), (4) Date: Jul. 30, 2004

(87) PCT Pub. No.: WO03/079119

PCT Pub. Date: Sep. 25, 2003

(65) Prior Publication Data

US 2005/0117940 A1 Jun. 2, 2005

(51) Int. Cl.
*G03G 15/16* (2006.01)
*G03G 15/00* (2006.01)

(52) U.S. Cl. ..... 399/316; 399/45

(58) Field of Classification Search ..... 399/316, 399/317, 388, 397, 45
See application file for complete search history.

(56) References Cited

U.S. PATENT DOCUMENTS 4,392,738 A * 7/1983 Fujino et al. ..... 399/317
4,839,697 A * 6/1989 Kamitamari et al. ..... 399/316
5,196,885 A 3/1993 Takeuchi et al.
5,937,259 A * 8/1999 Kopp et al. ..... 399/316
6,550,657 B1 * 4/2003 Taguchi ..... 399/388

FOREIGN PATENT DOCUMENTS

| | | |
|---|---|---|
| DE | 43 12 628 | 10/1993 |
| DE | 198 20 249 | 6/1999 |
| JP | 55-088086 | 7/1980 |
| JP | 5-119635 | 5/1993 |
| JP | 06-348152 | 12/1994 |
| JP | 2000-172090 | 6/2000 |
| JP | 2000-305368 | 11/2000 |

* cited by examiner

*Primary Examiner*—Susan Lee
(74) *Attorney, Agent, or Firm*—Morgan, Lewis & Bockius LLP

(57) ABSTRACT

The invention relates to a transfer mechanism for transferring an image on a photosensitive drum (4) onto an image forming member (2), and the transfer mechanism is provided with a mechanism (28-2, 40 to 47) for changing the curvature of the print medium (2) bent by the transfer guides (10) in order to make the transfer performance of print mediums having different stiffness uniform, in addition to an approach/retraction mechanism (28-1, 50 to 56) of the transfer guides (10). Since the amount of bite of the print medium to the image forming member can be changed by changing the curvature according to the type of a print medium, a uniform transfer press force can be maintained without the occurrence of transfer displacement, thereby print quality can be improved in various types of print mediums.

18 Claims, 8 Drawing Sheets

IMAGE TRANSFER MECHANISM AND IMAGE FORMING DEVICE USING THE MECHANISM

TECHNICAL FIELD

The present invention relates to an image transfer mechanism that causes a print medium to come into contact with an image forming member and transfers an image on the image forming member onto the print medium and to an image forming apparatus using the image transfer mechanism. More particularly, the present invention relates to an image transfer mechanism having a medium guide for causing the print medium to come into contact with the image forming member and to an image forming apparatus using the image transfer mechanism.

BACKGROUND ART

An image forming apparatus that makes use of an electrophotographing system has been used as a high speed image forming apparatus. In the image forming apparatus, a toner image formed on an image forming member such as a photosensitive drum and the like is transferred onto a print medium. In the high speed image forming apparatus, since the print medium is transported at a high speed, a transfer mechanism is necessary to maintain a transfer performance.

FIG. 10 is a structural view of a transfer mechanism of a conventional image forming apparatus. A toner image is formed on a photosensitive drum 104 rotating in the direction of an arrow by a known electrophotographing system. A continuous sheet 100 acting as a print medium is transported by upper and lower tractors not shown. A pair of sheet guide members (referred to as transfer guides) 102 facing each other and each having a predetermined distance from the photosensitive drum 104 are disposed in the vicinity of a corona transfer unit 106 of a transfer section.

The continuous sheet 100 to be transferred is guided by the transfer guides 102 in the transfer section and bent by the curvature of the sheet guide members 102. At the time, the bent portion of the sheet 100 comes into intimate contact (nipped by) with the photosensitive drum 100 by the stiffness of thereof, and the toner image on the photosensitive drum 104 can be transferred by the charging executed by the corona electric charger 106.

The transfer characteristics of the sheet 100 greatly depend on the intimate contact property thereof with the photosensitive drum 104 which is determined by the stiffness of the sheet at that time. Further, when sheet is loaded or when print is stopped, the transfer guides 102 are retracted to the positions shown by dotted lines in the figure to prevent the pollution of the sheet 100 by preventing the bent portion of the sheet 100 from coming into contact with the photosensitive drum 104.

In contrast, recently, the image forming apparatus is required to handle various types of print mediums, and it is required to make print on such mediums as, for example, a thin sheet having an extremely small ream weight and a stepped medium having a health insurance card and the like attached on a surface thereof. Further, an increase in a print speed reduces a margin to the stiffness of a sheet for obtaining desired transfer characteristics.

Accordingly, in a sheet having weak stiffness (for example, a thin sheet having a ream weight less than 45 kg) has an insufficient press force (intimate contact force) to the photosensitive drum 104, thereby the transfer performance is deteriorated. For example, transfer omission is caused in perforated tear lines of a sheet. On the contrary, in a sheet having strong stiffness (for example, a thick sheet having a ream weight of 135 kg or more), since the press force (intimate contact force) to the photosensitive drum 104 is excessively large, a load between the photosensitive drum and the sheet is increased, thereby a trouble occurs in the transportation of the sheet, from which a secondary trouble such as the detachment of the sheet from the tractors, and the like is caused.

Heretofore, the following methods have been proposed as a method of preventing the variation of the transfer characteristics resulting from the diversification of the print mediums.

A first method is to use a transfer roller as a transfer unit and to change the nip width of a sheet by the press force of the transfer roller. That is, the press force of the transfer roller is increased to a thin sheet so that an amount of bite is increased by increasing the nip width, whereas the press force of the transfer roller is reduced to a thick sheet so that the amount of bite is reduced by decreasing the nip width.

A second method is to change the position at which a sheet begins to come into contact with a photosensitive drum so that a thin sheet is caused to come into contact with the photosensitive drum more upstream of a transfer section (for example, Japanese Patent Application Laid-open No. 6-348152).

In the conventional arts described above, the press force of a sheet to the photosensitive drum is optimized by increasing or decreasing an amount of bite of nip, by which the nip width of the sheet is changed.

It seems that, in the relationship between the circumferential speed of a photosensitive drum and a sheet transportation speed, a constant speed difference is maintained at all times when it is examined from a macroscopic viewpoint. However, when this relationship is examined from a microscopic viewpoint, it generally has an error component due to the jitters of a drum motor and a sheet transportation motor and to the fluctuation of the rotation number of the drum.

Accordingly, when the nip width is increased, that is, when the portion where the photosensitive drum is in contact with the sheet is increased, the error component is increased in proportion to the increase in the contact portion, which may result in the promotion of transfer displacement.

FIGS. 11 and 12 are views illustrating the result of measurement of a nip width and an amount of transfer displacement. First, as shown in FIG. 11, as to the nip width, after the sheet 100 is loaded on the sheet guide members 102, a carbon sheet 108 is inserted between the photosensitive drum 104 and the transfer section in the state that the sheet 100 is fixed, and only the photosensitive drum 104 is rotated. Next, the rotation of the photosensitive drum 104 is stopped, and the width of the carbon transferred onto the sheet 100, that is, the nip width is measured. With the above operation, the nip width can be measured at the positions of the transfer guides.

Next, the sheet guide members 102 are raised using spacers and the like and moved in the directions of arrows in FIG. 11, and the nip width is measured by inserting a carbon sheet 108 at the positions likewise. With the above operations, the positions of the transfer guides corresponding to respective nip widths are obtained.

Then, a toner image of one-dot line is formed on the photosensitive drum 104 in an auxiliary scan direction at each of the positions of the transfer guides, and the toner image is transferred onto the sheet by transporting the sheet. The thickness of the one-dot line on the sheet, onto which the toner image has been transferred, is measured with a dot analyzer, and an amount of transfer displacement is measured.

FIG. 12 is a graph showing the result of measurement of an amount of transfer displacement with reference to a nip width, in which the lateral axis shows the nip width (mm), and the vertical axis shows the amount of transfer displacement (mm). As shown in FIG. 12, it can be found that the amount of transfer displacement is increased by the increase of the nip width. For example, although a nip width of 5 mm results in a line width (0.3 mm), a nip width of 15 mm results in a line width (0.8 mm) that is about 2.6 times as large as the above line width, by which print quality is deteriorated.

DISCLOSURE OF THE INVENTION

Accordingly, an object of the present invention is to provide an image transfer mechanism and an image forming apparatus for maintaining a transfer performance by changing an amount of bite of nip according to a type of a print medium without changing a nip width.

Another object of the present invention is to provide an image transfer mechanism and an image forming member for preventing transfer displacement even if the amount of bite of nip changes according to a type of a print medium.

Still another object of the present invention is to provide an image transfer mechanism and an image forming member for changing the amount of bite of nip by transfer guides according to a type of a print medium without changing the nip width by the transfer guides.

A further object of the present invention is to provide an image transfer mechanism and an image forming apparatus for maintaining a transfer performance by changing the amount of bite of nip according to a type of a print medium without changing the nip width by a simple structure for operating the transfer guides.

A still further object of the present invention is to provide an image transfer mechanism and an image forming apparatus for maintaining a transfer performance by detecting a type of a print medium to be loaded and changing the amount of bite of nip according to the type of the print medium without changing the nip width by operating the transfer guides.

To achieve the above objects, the image transfer mechanism or the image forming apparatus of the present invention includes a transfer guide for bending the print medium at a transfer position, a transfer guide drive mechanism for moving the transfer guide to a contact position at which the bent portion of the print medium is caused to come into contact with the image forming member and to a retracting position at which the bent portion is separated from the transfer guide, and a curvature change mechanism for changing, when the transfer guide is located at the contact position, the curvature of the print medium bent by the transfer guide.

In the present invention, since the mechanism for changing the curvature of the print medium bent by the transfer guide is provided in addition to the transfer guide drive mechanism, the amount of bite of nip can be changed according to the print medium without changing the nip width. Therefore, an intimate contact force in transfer can be made uniform while preventing transfer displacement, thereby the transfer performance can be improved.

In the image transfer mechanism or the image forming apparatus of the present invention, the transfer guide drive mechanism is preferably composed of a mechanism for moving the transfer guide by turning the transfer guide about a guide fulcrum, and the curvature change mechanism is preferably composed of a mechanism for changing the curvature of the print medium bent by the transfer guide by moving the position of the fulcrum, thereby the curvature can be changed without affecting the operation of a contact/retraction mechanism of the transfer guide.

In the image transfer mechanism or the image forming apparatus of the present invention, the transfer guide is preferably composed of a pair of transfer guide members for guiding the print medium on both the sides of the transfer position, the transfer guide drive mechanism is preferably composed of a mechanism for driving the pair of transfer guide members to the contact position and to the retracting position, and the curvature change mechanism is preferably composed of a mechanism for changing the curvature of the print medium bent by the transfer guide without changing the extreme end positions of the pair of transfer guides. With the above structure, the curvature can be greatly changed, which permits various types of print mediums to be handled.

In the image transfer mechanism or the image forming apparatus of the present invention, the transfer guide drive mechanism is preferably composed of a single drive source and a link mechanism for driving the pair of transfer guide members by the driving force of the drive source, thereby a simple structure can be realized.

In the image transfer mechanism or the image forming apparatus of the present invention, the curvature change mechanism is preferably composed of a single drive source and a link mechanism for driving the fulcrums of the pair of transfer guide members by the driving force of the drive source to change the curvature of the print medium bent by the pair of transfer guide members, thereby the curvature can be changed by a simple structure without affecting the transfer guide drive mechanism.

In the image transfer mechanism or the image forming apparatus of the present invention, the image on the image forming member is preferably a toner image, and a transfer means for electrically transferring the toner image is preferably interposed between the pair of transfer guide members, thereby the toner image can be transferred at a high speed.

The image transfer mechanism or the image forming apparatus of the present invention preferably further includes a detection mechanism for detecting the type of the print medium onto which the toner image is to be transferred, and a controller for controlling the curvature change mechanism according to an output from the detection mechanism, thereby an optimum transfer condition can be automatically set according to the type of the print medium.

Further, in the image transfer mechanism or the image forming apparatus of the present invention, the detection mechanism is composed of a mechanism for detecting the thickness of the print medium, thereby an optimum transfer press force can be automatically set according to the thickness of the print medium.

In the image forming apparatus of the present invention, when the print medium is loaded on the apparatus, the controller preferably controls the curvature change mechanism according to the output from the detection mechanism, thereby the curvature of the print medium is automatically set, which reduces the workload of an operator.

Further, in the image forming apparatus of the present invention, when the transfer guide is located at the retracting position, the controller controls the curvature change mechanism according to the output from the detection mechanism, thereby the press force can be changed without affecting the print medium.

BEST MODE FOR CARRYING OUT THE INVENTION

An embodiment of the present invention will be described below in the sequence of an image forming apparatus, an image transfer mechanism, an image transfer operation, and subsequently other embodiments will be described.

[Image Forming Apparatus]

Figure 1:
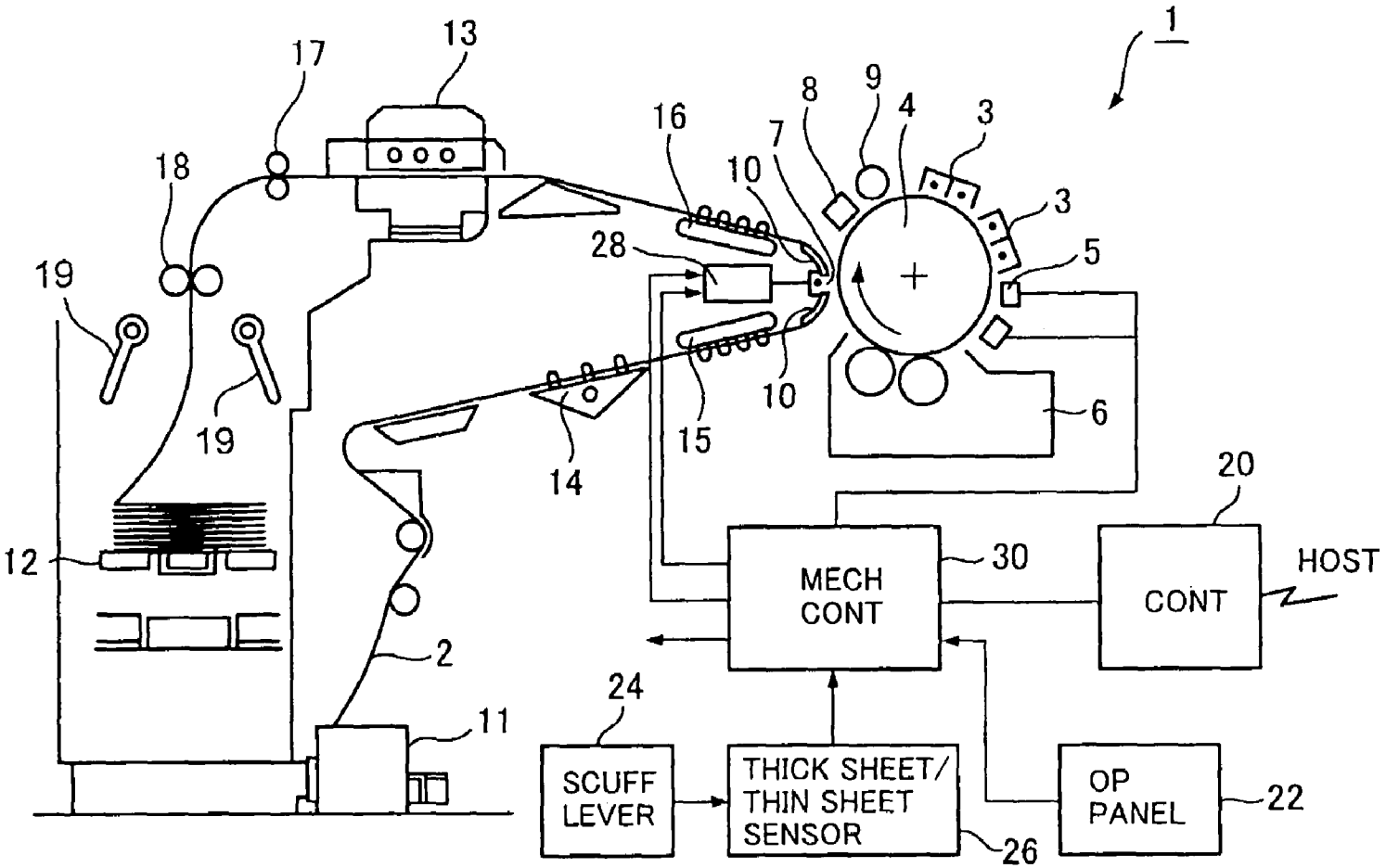
FIG. 1 is a structural view of an image forming apparatus of an embodiment of the present invention.

FIG. 1 is a structural view of an image forming apparatus of an embodiment of the present invention. FIG. 1 shows a continuous sheet page printer of an electrophotographing system as an example of the image forming apparatus. As shown in FIG. 1, a printer 1 is composed of an electrophotographing mechanism. After a photosensitive drum 4, which rotates in the direction of an arrow, is charged by an electric charger 3, it is exposed with an image by an LED (Light Emit Diode) head 5. With this operation, a latent image is formed on the photosensitive drum 4.

A developing unit 6 supplies a two-component developer to the photosensitive drum 4 and develops the latent image to a toner image. A transfer unit 7 is composed of a transfer roller, which is a transfer electric charger or a contact type transfer unit, and transfers the toner image on the photosensitive drum 4 onto a sheet (continuous sheet) 2. Further, transfer guides 10, which are disposed above and below the transfer unit 7, assist the sheet 2 to come into intimate contact with the photosensitive drum 4 in a transfer section. A cleaning mechanism 8 removes the toner remaining on the photosensitive drum 4 after the toner image has been transferred. A charge eliminating mechanism 9 eliminates electric charge from the photosensitive drum 4 after the toner image has been transferred.

The sheet 2 is composed of a continuous sheet partitioned to respective page units by perforated tear lines (perforated tear lines for folding or pages). The continuous sheet 2 has holes formed on the right and left edges thereof, and the holes are used to transport the sheet by a tractor, and right and left perforated tear lines are formed on the sheet to separate the portions thereof where the holes are formed.

The continuous sheet 2 is piled in a hopper 11. The sheet 2 in the hopper 11 is loaded on the apparatus by a sub-tractor 14, introduced to a transfer position by a lower tractor 15, and then transported to a flash fixing unit 13 by an upper tractor 16. Further, the continuous sheet 2 is pulled by scuff rollers 17 and 18, folded and assisted by swing rollers 19, and accommodated in a stacker 12. The flash fixing unit 13 fixes the toner image on the sheet 2 by flash light.

The printer 1 can execute high speed print and make the prints of, for example, 100 sheets or more per minute. The printer 1 is provided with a printer controller 20 and a mechanism controller 30. The printer controller 20 analyzes the command from a host not shown and creates an internal command and print data (bit map data). The print data is developed in a bit map memory.

The mechanism controller 30 controls the respective components 3, 4, 5, 6, 7, 8, 9, and 13 of the electrophotographing mechanism and the respective components 14, 15, 16, 17, and 18 of a transfer mechanism. The mechanism controller 30 has an operator's panel 22 connected thereto and receives commands such as a sheet load start command and the like therefrom. Further, there is provided a scuff lever 24 for changing the pinch pressure of the scuff rollers 17 and 18, and the scuff lever 24 adjusts the sheet pull force of the scuff rollers 17 and 18 according to the thickness of the sheet in the hopper 11.

A thick sheet/thin sheet sensor 26 detects whether the sheet is a thick sheet or a thin sheet by detecting the lever position of the scuff lever 24. The output from the thick sheet/thin sheet sensor 26 is input to the mechanism controller 30 which controls the driving of a transfer guide mechanism 28 according to the output as described later with reference to FIG. 5. As described in FIG. 2 and subsequent figures, the transfer guide mechanism 28 changes the positions of the transfer guides 10 according to a thick sheet/thin sheet as well as retracts the transfer guides 10 from or causes the transfer guides 10 to approach to the photosensitive drum 4 in response to a print command.

[Image Transfer Mechanism]

Figure 2:
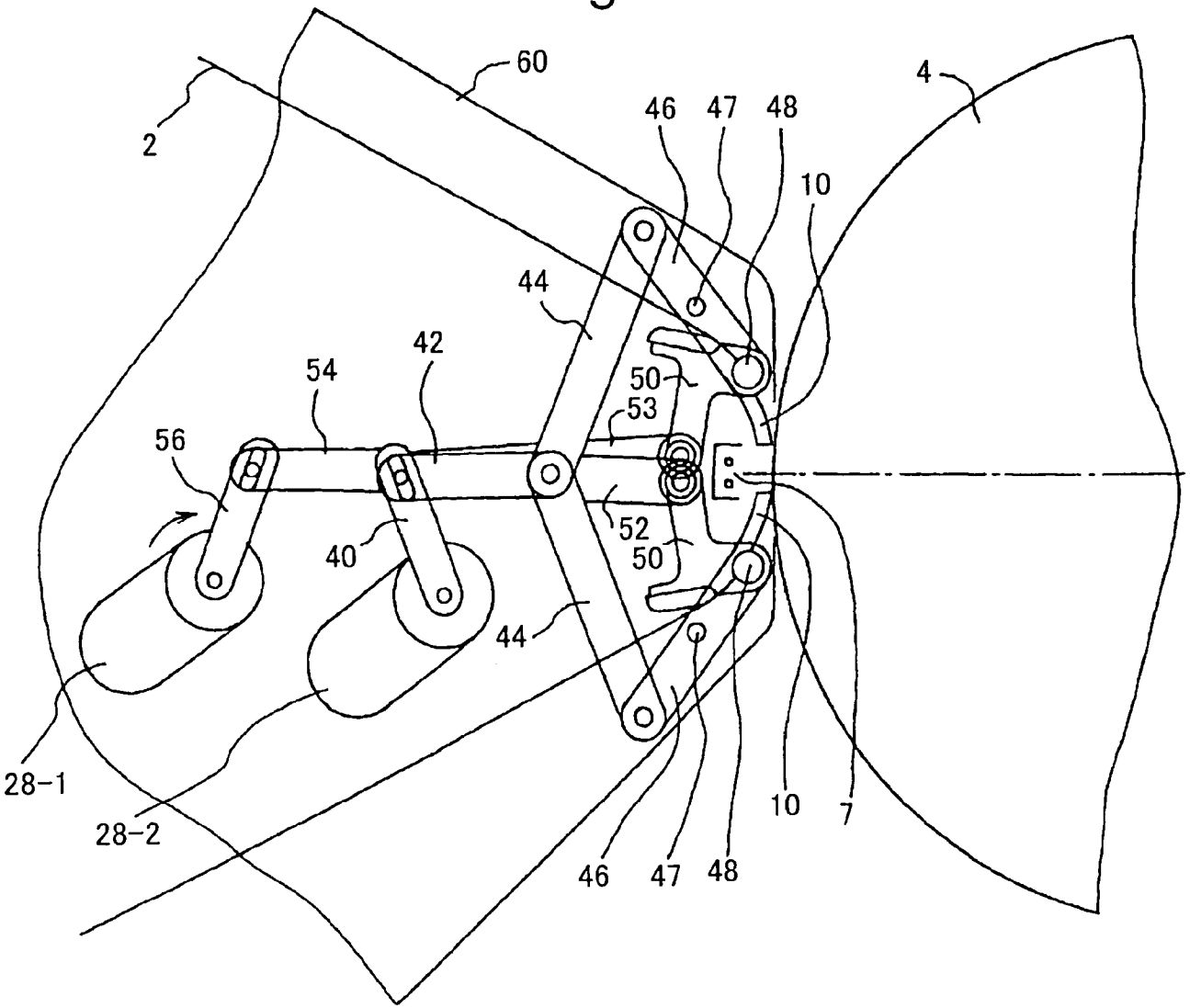
FIG. 2 is a structural view of an image transfer mechanism of FIG. 1.

FIG. 2 is a structural view of the transfer guide mechanism 28 of FIG. 1, and FIGS. 3 and 4 are views illustrating the operation of the transfer guide mechanism 28. As shown in FIG. 2, the pair of transfer guides 10 are provided with a pair of transfer arms 50 which turn about transfer guide fulcrums 48. The respective transfer arms 50 are connected to retraction links 52 and 53 at one ends thereof, and the retraction links 52 and 53 are coupled with the rotating shaft of a transfer guide motor 28-1 through drive links 54 and 56.

Accordingly, when the transfer guide motor 28-1 is rotated in the direction of an arrow as shown in FIG. 2, the drive link 56 is turned and pushes the pair of retraction links 52 and 53 in a right direction in the figure through the drive link 54 coupled therewith. As a result, the transfer arms 50 are turned counterclockwise about the transfer guide fulcrums 48. With the above operation, the transfer guides 10 protrude as shown in FIG. 2 and cause the sheet 2 to come into contact with the photosensitive drum 4.

In contrast, when the transfer guide motor 28-1 is rotated in a direction opposite to that shown by the arrow of FIG. 2 in the print (transfer) state of FIG. 2, the drive link 56 is turned counterclockwise, thereby the retraction links 52 and 53 are driven in a left direction in the figure through the drive link 54. Thus, since the transfer arms 50 are turned clockwise about the transfer guide fulcrums 48, the transfer guides 10 are separated from the photosensitive drum 4 and placed in a retracting state.

The present invention is provided with a curvature change mechanism of the transfer guides 10, in addition to the approaching/retracting mechanism of the transfer guides 10. As shown in FIG. 2, a frame 60 is provided with links 46 that are turned about fulcrums 47. One ends of the links 46 are coupled with the transfer guide fulcrums 48 of the transfer arms 50. On the other hand, the other ends of the links 46 are coupled with the rotating shaft of a curvature change motor 28-2 through links 44 and levers 42 and 40. Note that the transfer electric charger 7 is interposed between both the transfer guides 10.

The operation of the curvature change mechanism will be described as to an operation when a thick sheet of FIG. 3 is printed and as to an operation when a thin sheet of FIG. 4 is printed.

Figure 3A:
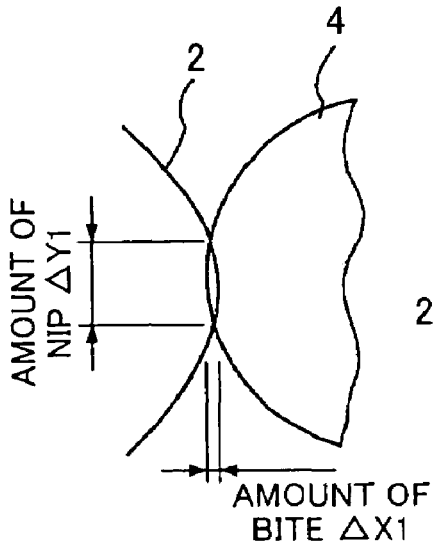
FIG. 3 is a view illustrating the operation of the image transfer mechanism of FIG. 1 when a thick sheet is printed.
Figure 3B:
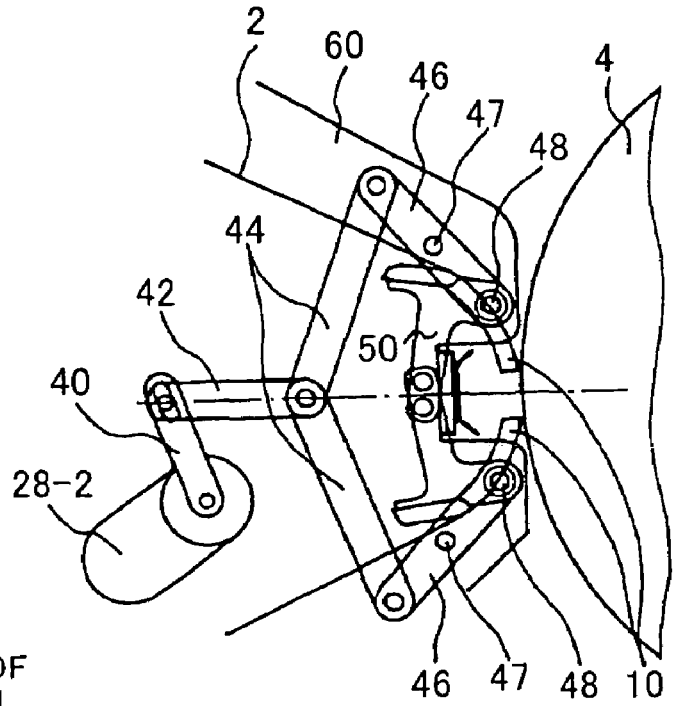

As shown in FIG. 3(B), when the thick sheet is printed, the lever 40, which is coupled with the rotating shaft of the curvature change motor 28-2 is located at a left position, and the links 46, which turn about the fulcrums 47, locate the transfer guide fulcrums 48 at positions in the vicinities of the photosensitive drum 4 by means of the lever 42 and the pair of links 44 coupled with the lever 42.

Therefore, when the thick sheet is printed, the transfer guides 10 retract from and approach to the photosensitive drum 4 at the positions of the fulcrums 48. At the approach (transfer) positions shown in FIG. 3(B), the sheet 2 is bent in a relatively small curvature by the transfer guides 10. As a result, as shown in FIG. 3(A), the sheet 2 comes into contact with the photosensitive drum 4 with an amount of nip of $\Delta Y1$ and a small amount of bite of $\Delta X1$.

Figure 4A:
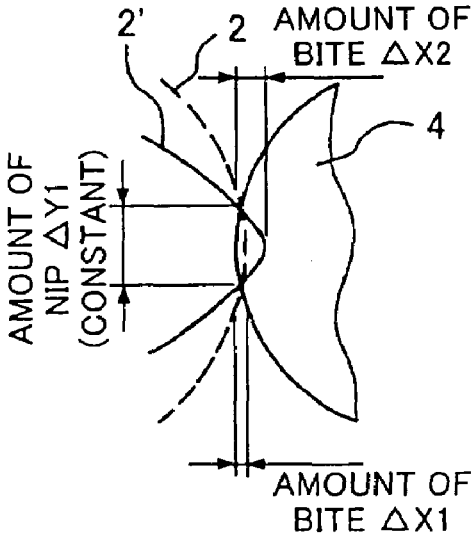
FIG. 4 is a view illustrating the operation of the image transfer mechanism of FIG. 1 when a thin sheet is printed.
Figure 4B:
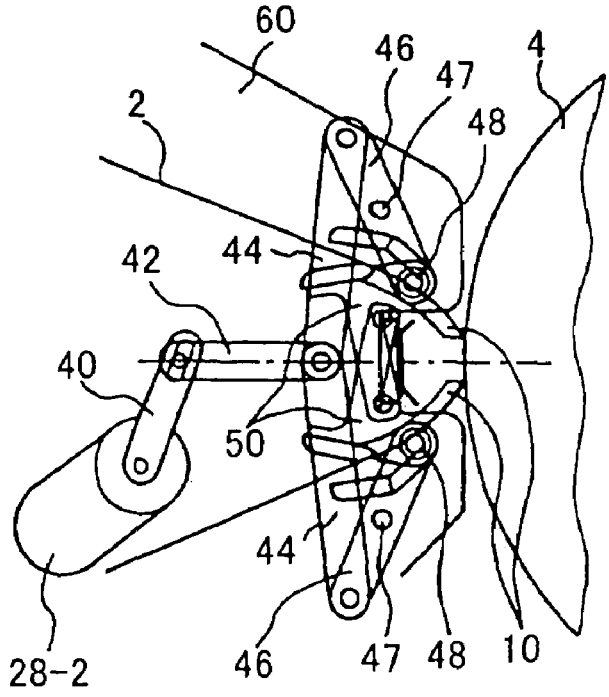

In contrast, as shown in FIG. 4(B), when the thin sheet is printed, the lever 40, which is coupled with the rotating shaft of the curvature change motor 28-2, is turned to a right position, and the links 46, which turn about the fulcrums 47, locate the transfer guide fulcrums 48 at positions apart from the photosensitive drum 4 by means of the lever 42 and the pair of links 44 coupled with the lever 42.

Therefore, when the thin sheet is printed, the transfer guides 10 retract from and approach to the photosensitive drum 4 at the positions of the fulcrums 48. At the approach (transfer) positions shown in FIG. 4(B), the sheet 2 is bent in a relatively large curvature by the transfer guides 10. As a result, as shown in FIG. 4(A), the sheet 2 comes into contact with the photosensitive drum 4 with the same amount of nip of $\Delta Y1$ and a large amount of bite of $\Delta X2$.

At the time, the positions of the transfer guide fulcrums 48 are changed so that the extreme end positions of the transfer guides 10 are not changed when the thick sheet is printed and when the thin sheet is printed. Accordingly, the amount of nip $\Delta Y1$ is not changed. In contrast, the amount of bite of the sheet is changed to the small amount $\Delta X1$ in the thick sheet and to the large amount $\Delta X2$ in the thin sheet according to the change of the curvature. Thus, the same press force (intimate contact force) as that of the thick sheet having strong stiffness can be applied also to the thin sheet having weak stiffness in a transfer operation by increasing the amount of bite.

As a result, transfer dislocation can be also prevented because the variation of transfer characteristics depending on a sheet can be prevented without changing a nip width.

[Image Transfer Operation]

Figure 5:
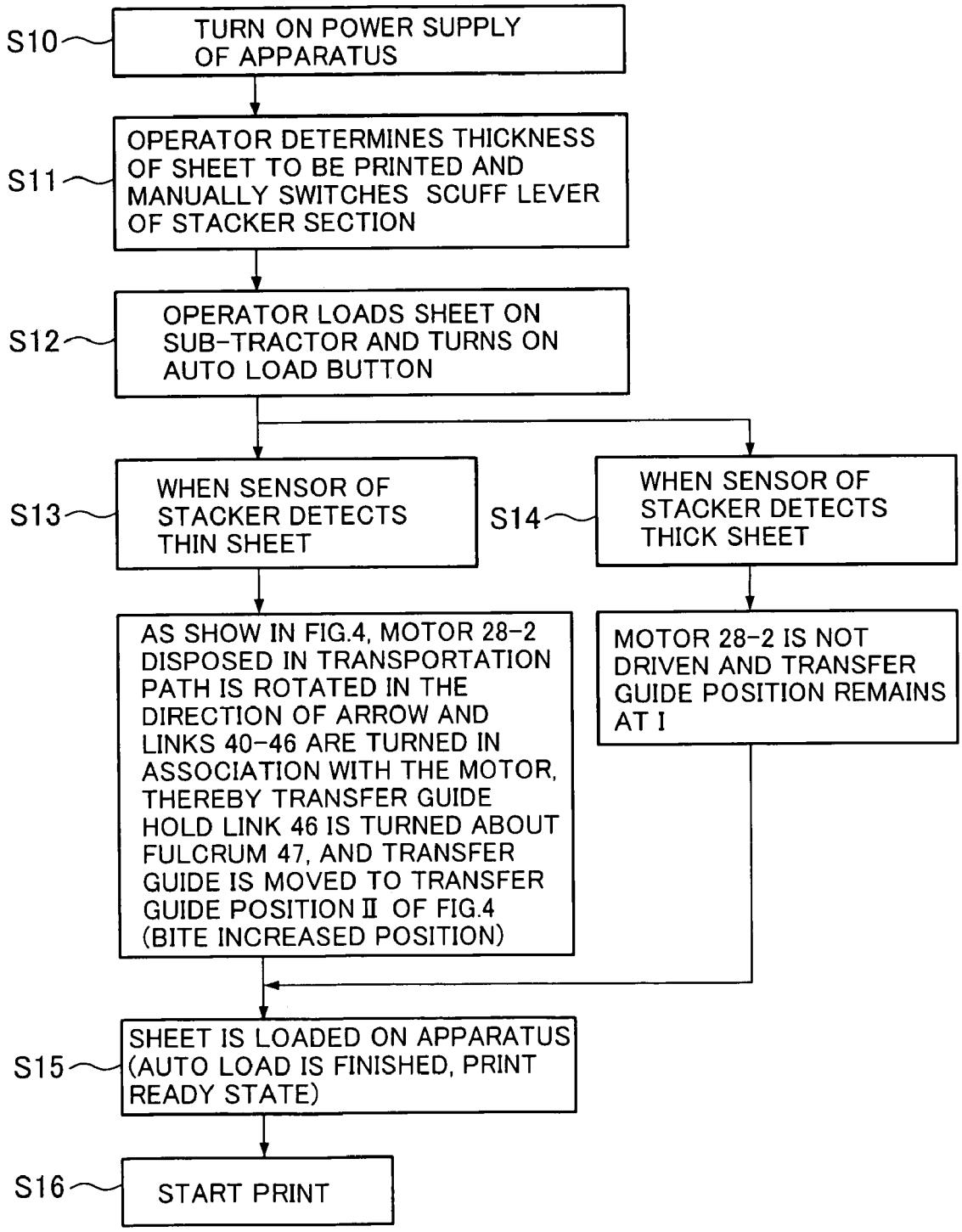
FIG. 5 is a flowchart of print start processing of FIG. 1.
Figure 6:
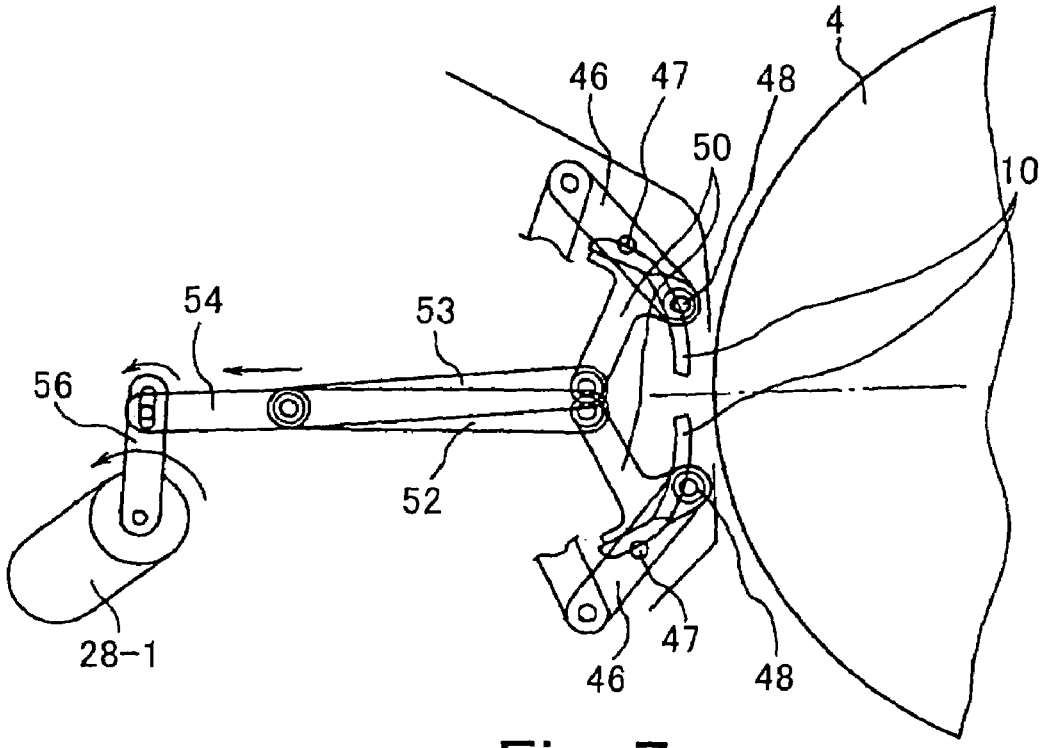
FIG. 6 is a view illustrating a retracting state when a thick sheet is detected in FIG. 5.
Figure 7:
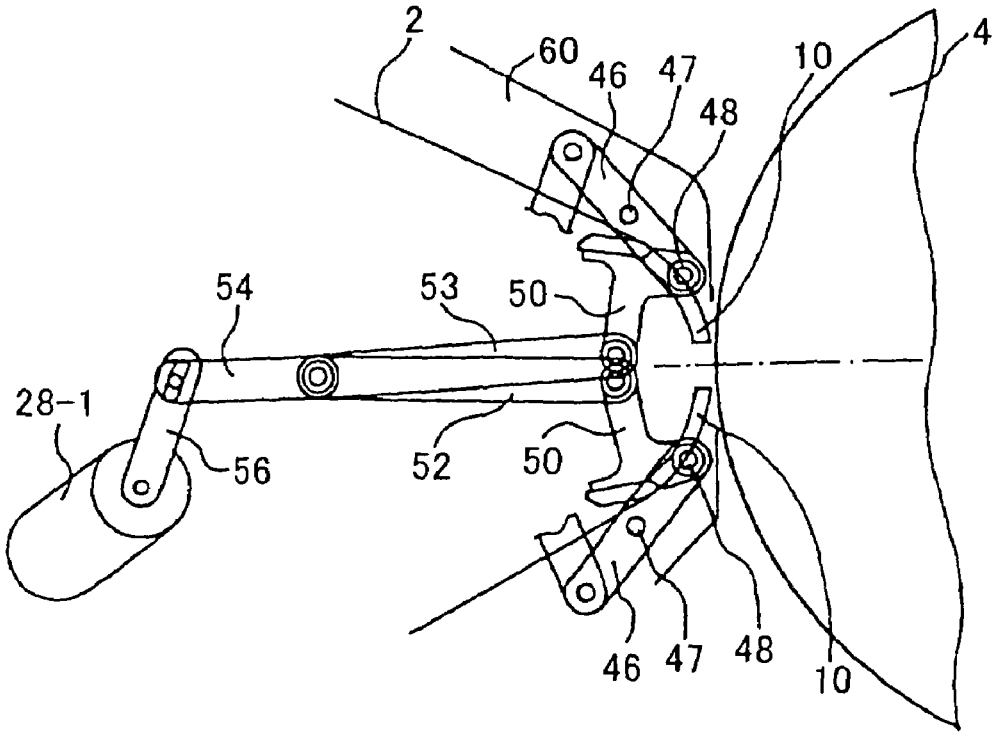
FIG. 7 is a view illustrating a transfer state when the thick sheet is detected in FIG. 5.
Figure 8:
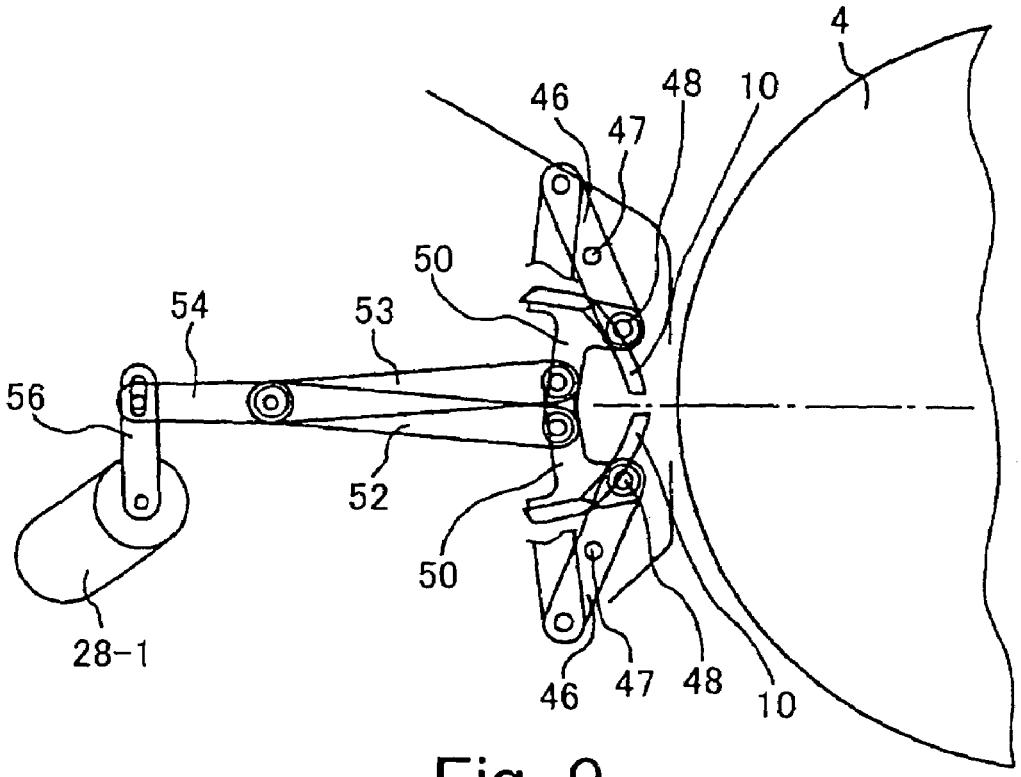
FIG. 8 is a view illustrating a retracting state when a thin sheet is detected in FIG. 5.
Figure 9:
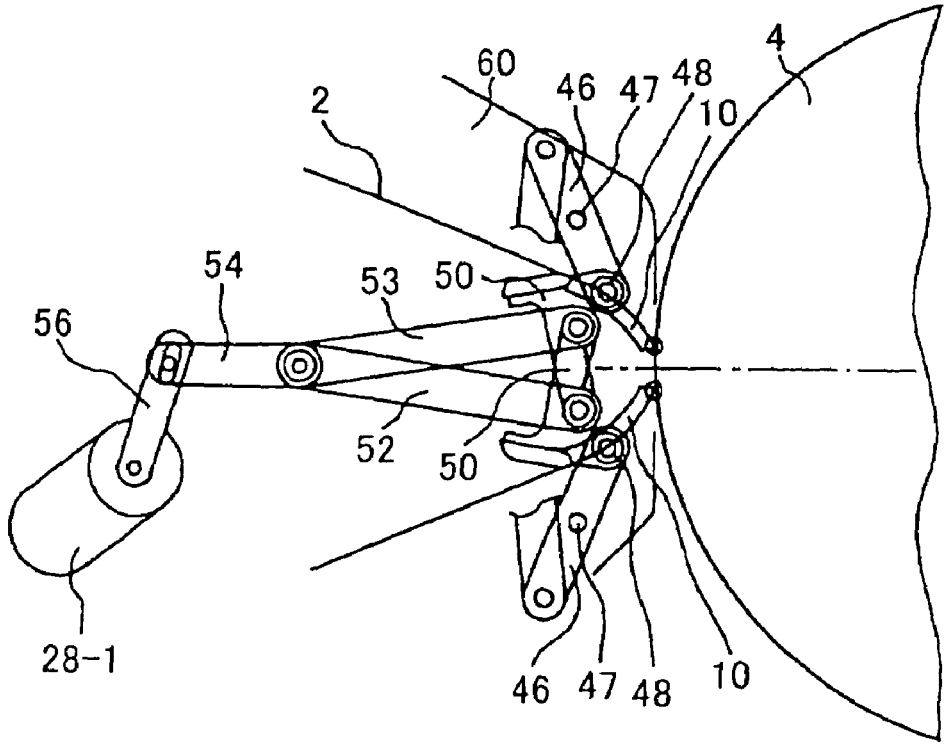
FIG. 9 is a view illustrating an operation in a transfer state when the thin sheet is detected in FIG. 5.
Figure 10:
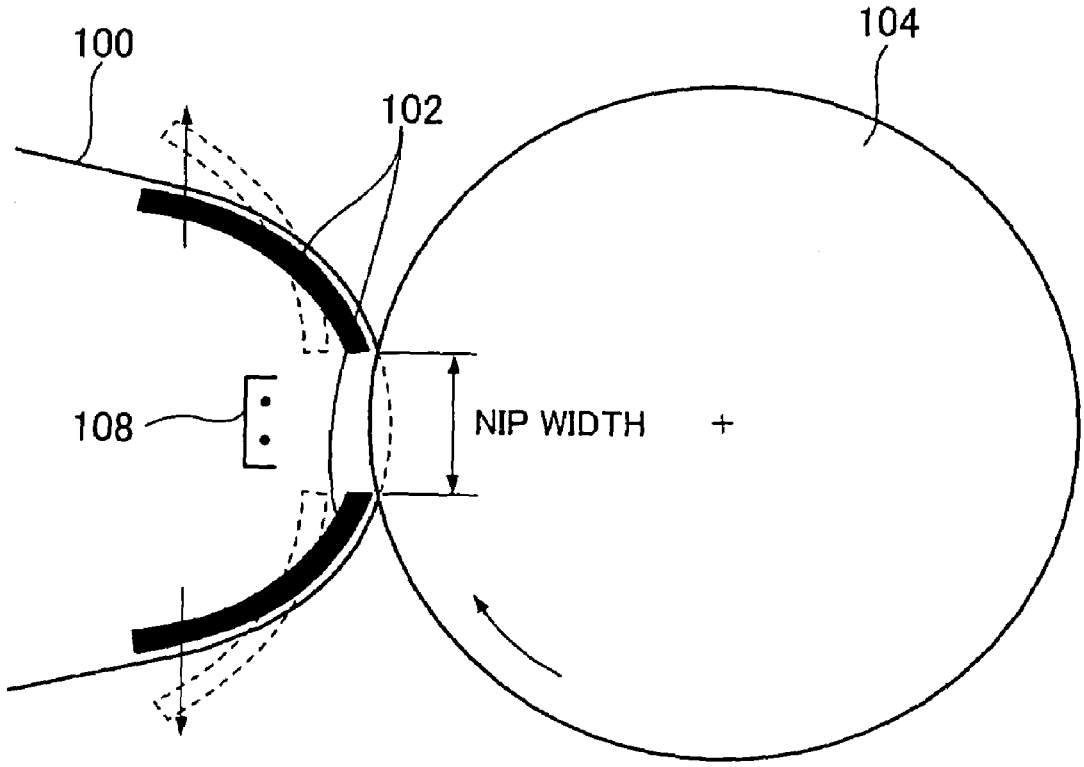
FIG. 10 is a sectional view of a conventional image transfer mechanism.
Figure 11:
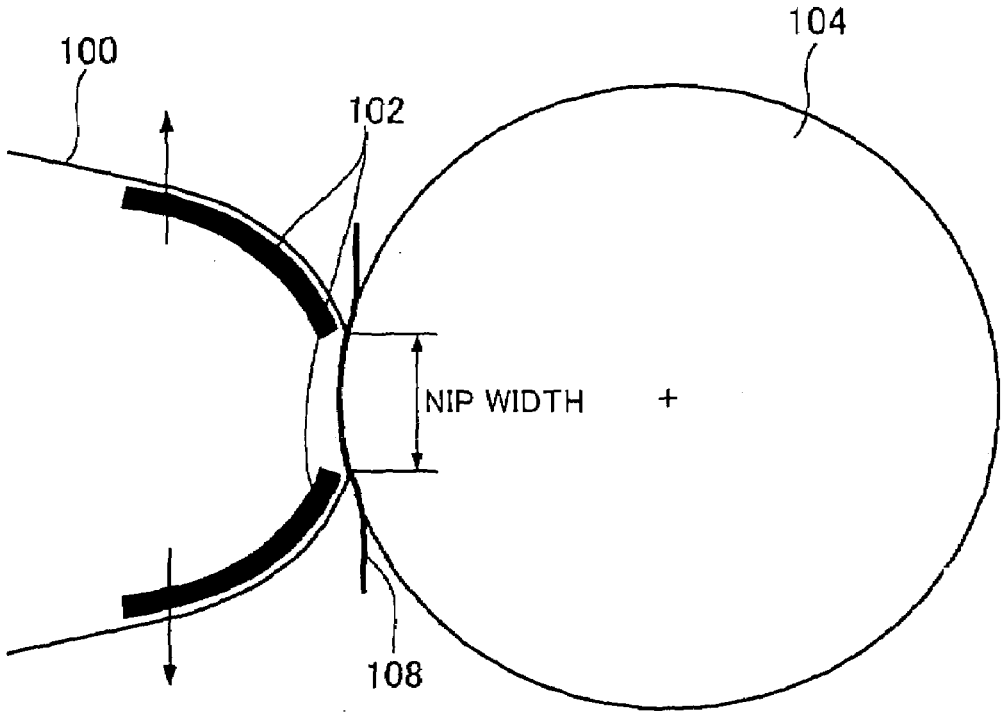
FIG. 11 is a view illustrating the measurement of transfer displacement in a conventional structure.
Figure 12:
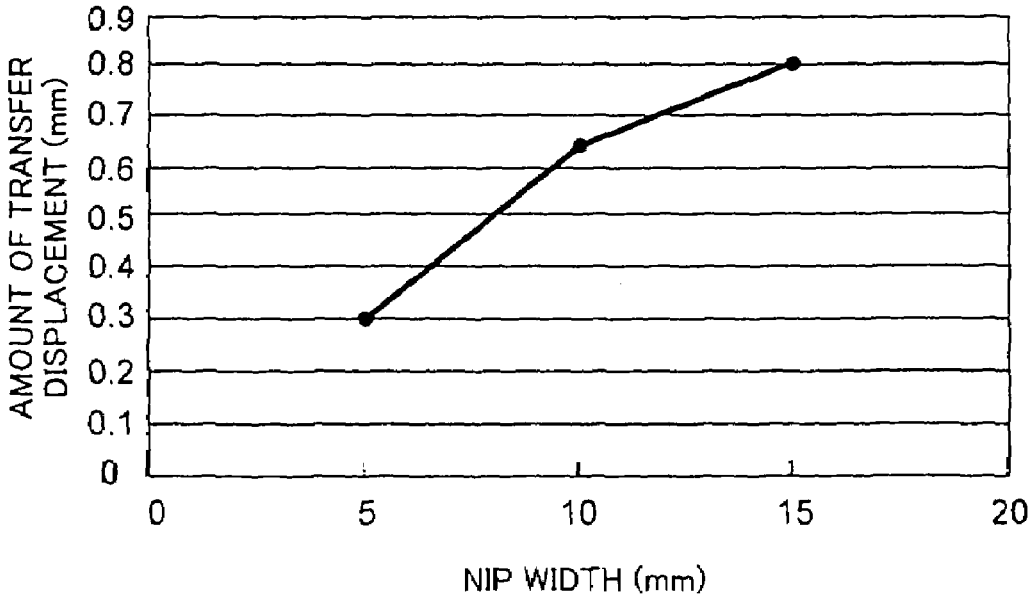
FIG. 12 is a characteristic view of an amount of transfer displacement with reference to a nip width in the conventional structure.

Image formation executed making use of the transfer mechanism described above will be described using FIGS. 5 to 9. FIG. 5 is a flowchart of print start processing executed by the mechanism controller of FIG. 1, FIG. 6 is a view showing a retracting state when the thick sheet is detected, FIG. 7 is a view showing a printing state when the thick sheet is detected, FIG. 8 is a view showing a retracting state when the thin sheet is detected, and FIG. 9 is a view showing a printing state when the thin sheet is detected.

The processing flow of FIG. 5 will be described with reference to FIGS. 6 to 9.

(S10) The apparatus is energized to start print. At the time, as an initial state, the transfer guides 10 are retracted, and the transfer guide fulcrums 48 are located at transfer guide positions I apart from the photosensitive drum 4 as shown in FIG. 6.

(S11) An operator manually operates the scuff lever 24 shown in FIG. 1 according to the thickness of the sheet to be printed and switches the scuff lever 24 to a thick sheet or a thin sheet.

(S12) Next, the operator mounts the sheet 2 in the hopper 11 on the sub-tractor 14 and depresses an auto load button of the operator's panel 22. The position of the scuff lever 24 is detected by the sensor 26, and an output, which indicates whether a stacker thin sheet sensor is turned on or a stacker thick sensor is turned on, is notified from the sensor 26 to the mechanism controller 30.

(S13) When the stacker thin sheet sensor is turned on, the mechanism controller 30 locates the transfer guides 10 at transfer guide positions II prior to automatic loading. That is, as described in FIG. 4(B), the curvature change motor 28-2 is rotated, and the lever 40 coupled with the rotating shaft thereof is turned to the right position. With this operation, the links 46, which turn about the fulcrums 47, locate the transfer guide fulcrums 48 at the positions II apart from the photosensitive drum 4 by means of the lever 42 and the pair of links 44 coupled therewith. At the time, the fulcrums 48 are moved in the state that the transfer guides 10 are located at retracting positions shown in FIG. 8. With the above operation, the amount of bite is increased as described in FIG. 4(A).

(S14) When the stacker thick sheet sensor is turned on, the mechanism controller 30 maintains the transfer guide positions I. That is, as shown in FIG. 6, the transfer guides 10 are located at the retracting positions, and the transfer guide fulcrums 48 are located at the positions in the vicinities of the photosensitive drum 4.

(S15) Next, the mechanism controller 30 drives the sub-tractor 14, the upper and lower tractors 15 and 16, and the scuff rollers 17 and 18 and automatically load the continuous sheet 2 mounted on the sub-tractor 14 by transporting it from the sub-tractor 14 to the scuff rollers 17 and 18 through the upper and lower tractors 15 and 16. At the time, when the thin sheet sensor is turned on, the transfer guides 10 guide the sheet 2 at the retracting positions as shown in FIG. 8, whereas when the thick sheet sensor is turned on, the transfer guides 10 guide the sheet 2 at the retracting positions as shown in FIG. 6.

(S16) Next, on receiving a print start command, the mechanism controller 30 drives the transfer guide motor 28-1 and moves the transfer guides 10 to the transfer position. At the time, when the thick sheet sensor is turned on, since the lever 40, which is coupled with the rotating shaft of the curvature change motor 28-2, is located at the left position as shown in FIG. 3(B), the links 46, which turn about the fulcrums 47, locate the transfer guide fulcrums 48 at the positions in the vicinities of the photosensitive drum 4 by means of the lever 42 and the pair of links 44 coupled with the lever 42. Therefore, when the thick sheet is printed, the transfer guides 10 retract (FIG. 6) from and approach (FIG. 7) to the photosensitive drum 4 at the positions of the fulcrums 48. At the approach (transfer) positions shown in FIGS. 3(B) and 7, the sheet 2 is bent in the relatively small curvature by the transfer guides 10. As a result, as shown in FIG. 3(A), the sheet 2 comes into contact with the photosensitive drum 4 with the amount of nip of ΔY1 and the small amount of bite of ΔX1.

On the other hand, when the thin sheet sensor is turned on, since the lever 40, which is coupled with the rotating shaft of the curvature change motor 28-2, is turned to the right position as shown in FIG. 4(B), the links 46, which turn about the fulcrums 47, locate the transfer guide fulcrums 48 at the positions apart from the photosensitive drum 4 by means of the lever 42 and the pair of links 44 coupled with the lever 42. Therefore, when the thin sheet is printed, the transfer guides 10 retract (FIG. 8) from and approach (FIG. 9) to the photosensitive drum 4 at the positions of the fulcrums 48. At the approach (transfer) positions shown in FIGS. 4(B) and 9, the sheet 2 is bent in the relatively large curvature by the transfer guides 10. As a result, as shown in FIG. 4(A), the sheet 2 comes into contact with the photosensitive drum 4 with the same amount of nip of ΔY1 and the large amount of bite of ΔX2.

At the time, the positions of the transfer guide fulcrums 48 are changed so that the extreme end positions of the transfer guides 10 are not changed when the thick sheet is printed and when the thin sheet is printed. Accordingly, the amount of nip ΔY1 is not changed. In contrast, the amount of bite of the sheet is changed to the small amount ΔX1 in the thick sheet and to the large amount ΔX2 in the thin sheet according to the change of the curvature. Thus, the same press force (intimate contact force) as that of the thick sheet having strong stiffness can be applied also to the thin sheet having weak stiffness in the transfer operation by increasing the amount of bite.

As a result, the transfer dislocation can be prevented because the variation of transfer characteristics depending on a sheet can be prevented without changing the nip width. Moreover, since the fulcrum positions in the rotations of the transfer guides 10 are changed, the curvature of a sheet can be changed without affecting the retracting/approaching mechanism of the transfer guides 10.

As described above, since the nip width is not changed even if the intimate contact force is made uniform according to the thickness of a sheet by controlling the press force, the transfer displacement can be prevented even if print is executed at a high speed, which permits a high speed electrophotographic printer to use various types of print mediums, thereby the use of the high speed printer can be increased.

Other Embodiments

Although the continuous sheet having the perforated tear lines has been described as a print medium in the above embodiment, the embodiment can be also applied to a cut medium, and the print medium is not limited to a paper sheet, and other materials can be applied as the print medium. Although the image forming apparatus has been described as to the page printer, it can be also applied to a copy machine, a facsimile, and the like.

Further, although the transfer guide mechanism and the curvature change mechanism that are composed of the motors and the link mechanisms have been described, they can be also realized by other mechanisms. Further, the image forming member can be also applied to other rotary members such as an intermediate transfer drum onto which an image on the photosensitive drum is transferred, and the like, in addition to the photosensitive drum.

Although the present invention has been described with reference to the embodiments, various modifications can be made in the present invention within the scope of the technical gist of the invention, and these modifications are not excluded from the technical scope of the present invention.

INDUSTRIAL APPLICABILITY

Since the mechanism, which changes the bending curvature of a print medium bent by the transfer guides, is provided in addition to the approach/retract mechanism of the transfer guides, the curvature and the amount of bite of a print medium to the image forming member can be changed according to a type of the print medium. As a result, no transfer displacement occurs, a uniform transfer press force can be maintained, and print quality can be improved in various types of print mediums.

The invention claimed is:

1. An image transfer mechanism for transferring an image formed on an image forming member being rotated to a print medium, characterized by comprising:

a transfer guide for bending the print medium at a transfer position;

a transfer guide drive mechanism for moving the transfer guide to a contact position at which a bent portion of the print medium is caused to come into contact with the image forming member and to a retracting position at which the bent portion is separated from the transfer guide; and a curvature change mechanism for changing, when the transfer guide is located at the contact position, the curvature of the print medium bent by the transfer guide.

2. An image transfer mechanism according to claim 1, characterized in that:

the transfer guide drive mechanism comprises a mechanism for moving the transfer guide by turning the transfer guide about a guide fulcrum; and the curvature change mechanism comprises a mechanism for changing the curvature of the print medium bent by the transfer guide by moving the position of the fulcrum.

3. An image transfer mechanism according to claim 1, characterized in that:

the transfer guide comprises a pair of transfer guide members for guiding the print medium on both the sides of the transfer position;

the transfer guide drive mechanism comprises a mechanism for driving the pair of transfer guide members to the contact position and to the retracting position; and the curvature change mechanism comprises a mechanism for changing the curvature of the print medium bent by the transfer guide without changing the extreme end positions of the pair of transfer guides.

4. An image transfer mechanism according to claim 3, characterized in that the transfer guide drive mechanism comprises a single drive source and a link mechanism for driving the pair of transfer guide members by the driving force of the drive source.

5. An image transfer mechanism according to claim 3, characterized in that the curvature change mechanism comprises a single drive source and a link mechanism for driving the fulcrums of the pair of transfer guide members by the driving force of the drive source to change the curvature of the print medium bent by the pair of transfer guide members.

6. An image transfer mechanism according to claim 3, characterized in that:

the image on the image forming member is a toner image; and transfer means for electrically transferring the toner image is interposed between the pair of transfer guide members.

7. An image transfer mechanism according to claim 1, further comprising:

a detection mechanism for detecting the type of the print medium onto which the toner image is to be transferred; and a controller for controlling the curvature change mechanism according to an output from the detection mechanism.

8. An image transfer mechanism according to claim 7, characterized in that the detection mechanism comprises a mechanism for detecting the thickness of the print medium.

9. An image forming apparatus for forming an image on a print medium, characterized by comprising:

transportation means for transporting the print medium;

an image forming member being rotated;

an image forming section for forming an image on the image forming member; and an image transfer mechanism for transferring the image on the image forming member onto the print medium, wherein the image transfer mechanism comprises:

a transfer guide for bending the print medium at a transfer position;

a transfer guide drive mechanism for moving the transfer guide to a contact position at which a bent portion of the print medium is caused to come into contact with the image forming member and to a retracting position at which the bent portion is separated from the transfer guide; and a curvature change mechanism for changing, when the transfer guide is located at the contact position, the curvature of the print medium bent by the transfer guide.

10. An image forming apparatus according to claim 9, characterized in that;

the transfer guide drive mechanism comprises a mechanism for moving the transfer guide by turning the transfer guide about a guide fulcrum; and the curvature change mechanism comprises a mechanism for changing the curvature of the print medium bent by the transfer guide by moving the position of the fulcrum.

11. An image forming apparatus according to claim 9, characterized in that:

the transfer guide comprises a pair of transfer guide members for guiding the print medium on both the sides of the transfer position;

the transfer guide drive mechanism comprises a mechanism for driving the pair of transfer guide members to the contact position and to the retracting position; and the curvature change mechanism comprises a mechanism for changing the curvature of the print medium bent by the transfer guides without changing the extreme end positions of the pair of transfer guides.

12. An image forming apparatus according to claim 11, characterized in that the transfer guide drive mechanism comprises a single drive source and a link mechanism for driving the pair of transfer guide members by the driving force of the drive source.

13. An image forming apparatus according to claim 11, characterized in that the curvature change mechanism comprises a single drive source and a link mechanism for driving the fulcrums of the pair of transfer guide members by the driving force of the drive source to change the curvature of the print medium bent by the pair of transfer guide members.

14. An image forming apparatus according to claim 11, characterized in that:

the image forming section is a mechanism for forming a toner image on the image forming member; and transfer means for electrically transferring the toner image is interposed between the pair of transfer guide members.

15. An image forming apparatus according to claim 9, further comprising:

a detection mechanism for detecting the type of the print medium onto which the toner image is to be transferred; and a controller for controlling the curvature change mechanism according to an output from the detection mechanism.

16. An image forming apparatus according to claim 15, characterized in that the detection mechanism comprises a mechanism for detecting the thickness of the print medium.

17. An image forming apparatus according to claim 15, characterized in that when the print medium is loaded on the apparatus, the controller controls the curvature change mechanism according to the output from the detection mechanism.

18. An image forming apparatus according to claim 15, characterized in that when the transfer guide is located at the retracting position, the controller controls the curvature change mechanism according to the output from the detection mechanism.

* * * * *